US008646536B2

(12) United States Patent
Travis et al.

(10) Patent No.: US 8,646,536 B2
(45) **Date of Patent: *Feb. 11, 2014**

(54) CAPILLARY HANGER ARRANGEMENT FOR DEPLOYING CONTROL LINE IN EXISTING WELLHEAD

(75) Inventors: Todd Travis, Humble, TX (US); Brandon Cain, Houston, TX (US); Eric Calzoncinth, Baytown, TX (US); Paul Perez, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/549,419

(22) Filed: Jul. 14, 2012

(65) Prior Publication Data

US 2013/0133898 A1 May 30, 2013

Related U.S. Application Data

(60) Division of application No. 12/408,527, filed on Mar. 20, 2009, now Pat. No. 8,312,932, which is a continuation-in-part of application No. 12/128,811, filed on May 29, 2008, now Pat. No. 8,100,181.

(51) Int. Cl.
*E21B 19/02* (2006.01)

(52) U.S. Cl.
USPC ..... 166/379; 166/382; 166/75.14; 166/86.3; 166/77.1

(58) Field of Classification Search
USPC ..... 166/379, 382, 77.1, 85.1, 86.1, 88.1, 166/88.4, 75.14, 86.3
See application file for complete search history.

(56) References Cited

U.S. PATENT DOCUMENTS

| | | | |
|---|---|---|---|
| 3,494,417 | A | 2/1970 | Fredd |
| 3,910,352 | A | 10/1975 | Mott |
| 4,691,776 | A | 9/1987 | Pringle |

(Continued)

FOREIGN PATENT DOCUMENTS

| | | |
|---|---|---|
| CA | 2310236 | 12/2001 |
| EP | 0637675 | 2/1995 |

(Continued)

OTHER PUBLICATIONS

Combined Examination and Search Report in counterpart UK Appl. No. GB0906097.1, dated Aug. 10, 2009, 3 pgs.

(Continued)

*Primary Examiner* — David Andrews
(74) *Attorney, Agent, or Firm* — Wong, Cabello, Lutsch, Rutherford & Brucculeri LLP

(57) ABSTRACT

To deploy a capillary string through a wellhead to a downhole safety valve, a control port and a retention port are drilled in an adapter between a casing hanger and a gate valve or elsewhere. The capillary string is connected to a first port of a capillary hanger and installed through the wellhead. The capillary hanger is landed on a tubing hanger, and a side port on the capillary hanger communicates with the control port. Because the side port's location may not align with the control port, operators may need to measure how long the capillary hanger should be. A control line connects to the control port in the wellhead's side to communicate with the capillary line, and a retention rod inserts in the retention port to support the capillary hanger.

37 Claims, 11 Drawing Sheets

(56) References Cited

U.S. PATENT DOCUMENTS

| | | | | |
|---|---|---|---|---|
| 4,836,287 | A | 6/1989 | Eric et al. | |
| 5,092,400 | A | 3/1992 | Jagert | |
| 5,094,294 | A | 3/1992 | Bayh, III | |
| 5,148,865 | A | 9/1992 | Reed | |
| 5,203,409 | A | 4/1993 | Seid et al. | |
| 5,305,828 | A | 4/1994 | White et al. | |
| 5,358,053 | A | 10/1994 | Akkerman | |
| 5,361,834 | A | 11/1994 | Cox | |
| 5,662,169 | A | 9/1997 | Hosie | |
| 5,722,844 | A | 3/1998 | Schraeder | |
| 5,727,631 | A | 3/1998 | Baker et al. | |
| 5,865,255 | A | 2/1999 | Hammett et al. | |
| 6,227,300 | B1 | 5/2001 | Cunningham et al. | |
| 6,357,529 | B1 * | 3/2002 | Kent et al. | 166/344 |
| 6,688,386 | B2 | 2/2004 | Cornelssen et al. | |
| 6,715,554 | B1 | 4/2004 | Cunningham et al. | |
| 6,851,478 | B2 | 2/2005 | Cornelssen et al. | |
| 6,966,383 | B2 | 11/2005 | Milberger et al. | |
| 7,025,132 | B2 | 4/2006 | Kent et al. | |
| 7,040,409 | B2 | 5/2006 | Sangla | |
| 8,312,932 | B2 * | 11/2012 | Jones et al. | 166/379 |
| 2002/0000315 | A1 | 1/2002 | Kent et al. | |
| 2002/0011336 | A1 | 1/2002 | Baskett et al. | |
| 2002/0134548 | A1 | 9/2002 | Lam et al. | |
| 2003/0019631 | A1 | 1/2003 | DeBerry | |
| 2004/0079532 | A1 | 4/2004 | Allen et al. | |
| 2004/0112604 | A1 | 6/2004 | Milberger et al. | |
| 2004/0154790 | A1 | 8/2004 | Cornelssen et al. | |
| 2004/0262010 | A1 | 12/2004 | Milberger | |
| 2007/0056747 | A1 | 3/2007 | Jacob | |
| 2008/0029271 | A1 | 2/2008 | Bolding et al. | |
| 2008/0169097 | A1 | 7/2008 | Bolding et al. | |
| 2009/0000781 | A1 | 1/2009 | Bolding | |
| 2009/0294134 | A1 | 12/2009 | Jones et al. | |
| 2009/0294135 | A1 | 12/2009 | Jacob et al. | |
| 2009/0294136 | A1 | 12/2009 | Jones et al. | |
| 2010/0170679 | A1 | 7/2010 | Borak | |

FOREIGN PATENT DOCUMENTS

| | | | |
|---|---|---|---|
| FR | 2734863 | A1 | 12/1996 |
| GB | 1419850 | | 12/1975 |
| GB | 2287270 | | 9/1995 |
| GB | 2377954 | | 1/2003 |
| GB | 2421750 | | 7/2006 |
| GB | 2443083 | | 4/2008 |
| WO | 9904137 | | 1/1999 |
| WO | 2005008025 | | 1/2005 |
| WO | 2005008025 | A1 | 1/2005 |
| WO | 2006034214 | | 3/2006 |
| WO | 2006/133351 | A2 | 12/2006 |
| WO | 2008/089038 | | 7/2008 |
| WO | 2008/016663 | A2 | 8/2008 |

OTHER PUBLICATIONS

Combined Examination and Search Report in counterpart U.K. Appl. No. GB0904319.1, dated Aug. 10, 2009, 3pgs.

Office Action in co-pending U.S. Appl. No. 12/128,790, dated Sep. 14, 2009.

Reply to Office Action of Sep. 14, 2009 in co-pending U.S. Appl. No. 12/128,790, filed Dec. 14, 2009.

PEDCOR, "Series 10-400 Chemical Injector Adapter," dated Jan. 5, 1995, 1-pg.

PEDCOR, "RF Hanger from PEDCOR Inc. in Houston, Texas which designs and manufactures coiled tubing tools, downhole tools, wellhea . . . ," generated on Apr. 32, 2006, obtained from http://www.pedcor.com/wellhead-equipment/rf_hanger.html, 3 pgs.

PEDCOR, "Wellhead Equipment Sub: Standard Hanger," generated on Apr. 21, 2006, obtained from http://www.pedcor.com/wellhead-equipment/standard_mandrel_hanger.html, 3-pgs.

PEDCOR, "Conventional DHSV Coiled Tubing Completion from PEDCOR Inc in Houston, Texas which designs and manufactures coiled . . . ," generated on Apr. 21, 2006, obtained from http://pedcor.com/wellhead-equipment/conventional_dhsv_ct_completion.html Apr. 21, 2006, 3-pgs.

Bolding, "Damaged Control Line Replacement Safety Valve System: Thru Tubing," generated on Feb. 2, 2010, obtained from http://onepetro.org/mslib/servlet/onepetropreview?id=SPE-121407-MS&soc=SPE.

American Completion Tools, "Flanged Gate Valve Part List," generated on Mar. 12, 2010, obtained from http://www.americancompletion tools.com/wellhead-x-mastree-gatevalves-manifolds/.

American Completion Tools, "Slab Gate Valve Part List," generated on Mar. 12, 2010, obtained from http://www.americancompletion tools.com/wellhead-x-mastree-gatevalves-manifolds/.

Search Report for Application No. GB0904319.1, dated Sep. 13, 2010.

Search Report for Application No. GB0904319.1, dated Sep. 10, 2010, claims searched 17-22.

Search Report for Application No. GB0904319.1, dated Sep. 10, 2010, claims searched 23-30.

Search Report for Applicaiton No. GB0904319.1, dated Sep. 10, 2010, claims searched 31-35.

Supplemental UK Examination Report for corresponding appl. GB0904319.1, dated Jan. 31, 2011, 3-pgs.

UK Search Report dated Nov. 26, 2010, for Application No. GB1019049.4.

Office Action received in corresponding U.S. Appl. No. 12/128,811 dated Oct. 29, 2010.

Response to Office Action received in corresponding U.S. Appl. No. 12/128,811 dated Feb. 28, 2011.

Office Action from corresponding U.S. Appl. No. 12/128,811, dated Apr. 15, 2011.

Reply to Office Action from corresponding U.S. Appl. No. 12/128,811, filed Jul. 13, 2011.

Final Office Action from corresponding U.S. Appl. No. 12/128,811, dated Aug. 3, 2011.

Reply to Final Office Action from corresponding U.S. Appl. No. 12/128,811, filed Sep. 2, 2011.

Notice of Allowance from corresponding U.S. Appl. No. 12/128,811, mailed Sep. 16, 2011.

Canadian Office Action from counterpart application No. 2,696,583, dated Jun. 8, 2011.

Office Action received in U.S. Appl. No. 12/128,811 dated Oct. 29, 2010.

Response to Office Action received in U.S. Appl. No. 12/128,811 dated Feb. 28, 2011.

Weatherford International Ltd., "Thru-Tubing Intervention: PB Packer," (c) 2006.

Weatherford International Ltd., "Thru-Tubing Intervention: GP Gravel-Pack System," (c) 2006.

Weatherford International Ltd., "Thru-Tubing Packers: ER Packer," (c) 2008, obtained from www.weatherford.com on Mar. 13, 2008.

Weatherford International Ltd., "Thru-Tubing Packers: WidePak(TM) Packer," (c) 2008, obtained from www.weatherford.com on Mar. 13, 2008.

Select Energy Systems, "Model 2500R Flanged CT Hanger," undated, obtained from http://www.selectsi.com/select_energy/PDFs/01.pdf, showing date modified as Apr. 10, 2006.

Select Energy Systems, "Model 2500 Flanged CT Hanger," undated, obtained from http://www.selectsi.com/select_energy/PDFs/04.pdf, showing date modified as May 26, 2010.

Select Energy Systems, "Installation Procedure: Model 2500 CT Hanger," undated, obtained from http://www.selectsi.com/select_energy/PDFs/02.pdf, showing date modified as Apr. 21, 2006.

Array, "API 6A Gate Valves: Manufacturers and distributors of high quality gate valves for wellhead, manifold, distribution and fracture applications," (c) 2007, obtained from www.arrayproducts.com , Document # BR-020-10 Rev B.

Wellhead Distributors Int'l, "Wellhead Housing: WC-22 Casing Spools," undated, obtained at least as early as Aug. 30, 2010.

Klompsma, "The Development of a System to Restore Full Safety Valve Functionality to Wells with Blocked and Damaged Control Line," (c) 2009, SPE 123757, 10 pgs, 2009 SPE Offshore Europe Oil & Gas Conference & Exhibition Sep. 8-11, 2009.

(56) References Cited

OTHER PUBLICATIONS

Oilenco, "Tubing Hanger Plug," (c) 2009, obtained from www.oilenco.com at least as early as Aug. 30, 2010.
Weatherford, "Real Results: New Valve for Damaged Control Lines Saves Operator Millions on Workover Costs," (c) 2008, obtained from www.weatherford.com, showing created date Sep. 22, 2008.
Weatherford, "Renaissance Systems: Revive wells at a fraction of the cost of workovers with Weatherfords unique safety-valve innovations," (c) 2009, obtained from www.weatherford.com at least as early as Aug. 30, 2010.
Weatherford, "Real Results: Renaissance WDCL System Helps Shell NAM Increase Production, Avoid Costly Workover on Offshore North Sea Well," (c) 2009, obtained from www.weatherford.com, showing created date Jun. 23, 2006.
Weatherford, :Real Results: Renaissance WDCLP System Enables Major Operator to Avoid Costly Workover on North Sea Well for Savings of £5 Million, (c) 2010, obtained from www.weatherford.com, showing created date Mar. 31, 2010.
Wellhead Distributors Int'l, "Wellhead Housing: TCM Tubing Spools," undated, obtained from http://www.wellheaddistributors.com/ at least as early as Aug. 30, 2010.

* cited by examiner

CAPILLARY HANGER ARRANGEMENT FOR DEPLOYING CONTROL LINE IN EXISTING WELLHEAD

CROSS-REFERENCE TO RELATED APPLICATIONS

This application is a divisional of U.S. application Ser. No. 12/408,527, filed Mar. 20, 2009, which is a continuation-in-part of U.S. application Ser. No. 12/128,811, filed May 29, 2008, now U.S. Pat. No. 8,100,181, to which priority is claimed and which are both incorporated herein by reference in its entirety.

BACKGROUND

When an existing safety valve in a well becomes inoperable, operators must take measures to rectify the problem by either working over the well to install an entirely new safety valve on the tubing or deploying a safety valve within the existing tubing. In the past, operators may have simply deployed a subsurface controlled subsurface safety valve in the well. The subsurface controlled valves could be a velocity valve or Protected Bellows (PB) pressure actuated valve. However, regulatory requirements and concerns over potential blowout have prompted operators to work over the well rather than deploying such subsurface controlled valves. As expected, working over a well can be time consuming and expensive. Therefore, operators would prefer to deploy a surface controlled safety valve in the tubing of the well without having to work over the well.

Current technology primarily allows surface controlled safety valves to be deployed in wells that have either an existing tubing-mounted safety valve or a tubing-mounted safety valve landing nipple. In French Patent No. FR 2734863 to Jacob Jean-Luc, for example, a surface controlled safety valve device 100 is disclosed that can be landed in an existing landing nipple from which the original safety valve has been removed. This safety valve device 100 reproduced in FIGS. 1A-1B is set in the landing nipple 10 using a special adapter 160 that mechanically hold the locking dogs 102 and the flapper 104 of the device 100 until the device 100 can be properly positioned in the landing nipple 10. Then, when releasing the device 100, the adapter 160 must disengage from the device 100 so that the locking dogs 102 engage the nipple 10 while simultaneously letting the flapper 104 close. Moreover, these steps must be performed while not damaging a hydraulic connector 120 and intermediate tubing 130 exposed in the device 100 adjacent to where the special adapter 160 holds the device 100.

When deployed in the landing nipple 10, a conduit (not shown) communicated through the tubing connects to the device 100 to operate the flapper 104. This conduit conveys hydraulic fluid to the connector 120 connected to a fixed portion 123 in the device 100. This fixed portion 123 in turn communicates the fluid to the intermediate tubing 130 that is movable in the fixed portion 123. A cross port 132 from the intermediate tubing 130 communicates the fluid so that it fills a space 133 and moves a sleeve 134 connected to the intermediate tubing 130. As the sleeve 134 moves down against the bias of a spring, it opens the flapper 104. Because the mechanisms for operating the device 100 are exposed and involve several moving components, the mechanical operation of this device 100 is less than favorable. Moreover, the exposed mechanisms that operate the device 100 with their several moving parts can become damaged.

In U.S. Pat. No. 7,040,409 to Sangla, another safety valve device for wells is disclosed that can be deployed in tubing without the need for an existing landing nipple. This device 200 is reproduced in FIGS. 2A-2B. As shown in FIG. 2B, the lower part of the device 200 has a flapper 210 that closes by a spring (not shown) and opens by a sleeve 212 under the thrust action of a ring 214 connected to a piston 216. With sufficient hydraulic pressure in a valve opening chamber 218, the piston 216 and ring 214 press the sleeve 212 against the bias of the spring 213 so that the sleeve 212 slides down and opens the flapper 210. With the flapper 210 open, a passage 202 in the device 200 permits fluid communication through the device 200. In the absence of pressure in the chamber 218, the spring 213 pushes the sleeve 212 upwards so that the flapper 210 closes.

To position the device 200 in tubing 20, the lower part of the device 200 as shown in FIG. 2B has lower anchor dogs 220*a*. These lower dogs 220*a* are displaced radially by a lower piston 222*a* whose end has the shape of a cone on which the lower dogs 220*a* rest. The lower piston 222*a* is pushed under the lower dogs 220*a* by the hydraulic pressure in a lower anchor chamber 224*a* so that the displacement of the lower piston 222*a* locks the lower dogs 220*a* on the wall of tubing 20. Locks 226*a*, such as dog stops or teeth, hold the lower piston 222*a* in place even when the pressure has dropped in lower chamber 224*a*. The upper part of the device 200 as shown in FIG. 2A similarly has upper anchor dogs 220*b*, piston 222*b*, hydraulic chamber 224*b*, and locks 226*b*.

To create a seal in the tubing 20, the device 200 uses a pile of eight cups 230 that position between the device 200 and the tubing 20. These cups 230 have a general herringbone U or V shape and are symmetrically arranged along the device's central axis. Hydraulic pressure present in a sealing assembly chamber 234 displaces a piston 232 that activates the cups 230 against the tubing 20. Locks 236 hold this piston 232 in place even without pressure in the chamber 234.

Hydraulic pressure communicated from the surface operates the device 200. In particular, rods (not shown) from the surface connect to a connector 240 that communicates with internal line 242. This internal line 242 communicates with an interconnecting tube 250 to distribute hydraulic pressure to the valve opening chamber 234 via a cross port 243, to the anchor chamber 224*a-b* via cross ports 244*a-b*, and to the sealing assembly chamber 218 via the tube 250. A hydraulic pressure rise in line 242 transmits the pressure to all these chambers simultaneously. When the hydraulic pressure drops in line 242, the device 200 closes but remains in position, anchored and sealed. A special profile 204 arranged at the top of the device 200 can be used to unanchor the device 200 by traction and jarring with a fishing tool suited to this profile 202. By jarring on the device 200, a series of shear pins are broken, thus releasing anchor pistons 222*a-b* and the sealing piston 232. The released device 200 can then be pulled up to the surface.

As with the valve 100 of FIGS. 1A-1B, the valve 200 of FIGS. 2A-2B also has features that are less than ideal. First, the pile of cups 230 offers less than desirable performance to hold the device 200 in tubing 20. In addition, the intricate arrangement and number of components including line 242; cross ports 243 and 244*a-b*; tube 250; multiple chambers 218, 224*a-b*, and 234; multiple pistons 216, 222*a-b*, and 232; and exposed rod 216 make the device 200 prone to potential damage and malfunction and further make manufacture and assembly of the device 200 difficult and costly.

Accordingly, a need exists for more effective subsurface safety valves that can be deployed in a well.

SUMMARY

Capillary hanger arrangements allow operators to deploy a capillary string through the bore of an existing wellhead so the string can communicate hydraulic fluid with a safety valve or other hydraulic tool downhole. For example, operators tap a control port and a retention port in the side of the wellhead, such as in an adapter between a casing hanger and a gate valve or elsewhere. After the hydraulic tool has been deployed downhole, operators then connect the capillary string to a first port of an internal passage in a capillary hanger and install the capillary string through the wellhead. Eventually, the capillary hanger is installed in the wellhead, for example, by landing a distal end of the capillary hanger on a tubing hanger in the wellhead. Once installed, a side port of the internal passing in the capillary hanger can communicate with the control line port tapped in the side of the wellhead. Because the side port's location may not align with the control port, operators may need to measure how long the capillary hanger should be and either modify its length or design it with the appropriate length. Once the hanger is installed, operators insert retention rods in the retention port to support the capillary hanger. Then, operators connect a control line to the control port in the wellhead's side so hydraulic fluid can communicate with the capillary line through the internal passage in the capillary hanger. Eventually, fluid flow in the wellhead is allowed to flow through an axial flow passage in the capillary hanger. These and other embodiments are disclosed herein.

DETAILED DESCRIPTION

As disclosed herein, a surface controlled subsurface safety valve apparatus can be installed in a well that either has or does not have existing hardware for a surface controlled valve. Coil tubing communicates the hydraulic fluid to the apparatus to operate the valve. One disclosed valve apparatus deploys in a well that has an existing safety valve nipple and is retrievable therefrom. Another disclosed valve apparatus deploys in tubing of a well with or without a safety valve nipple.

I. Retrievable Surface Controlled Subsurface Safety Valve

Figure 1A:
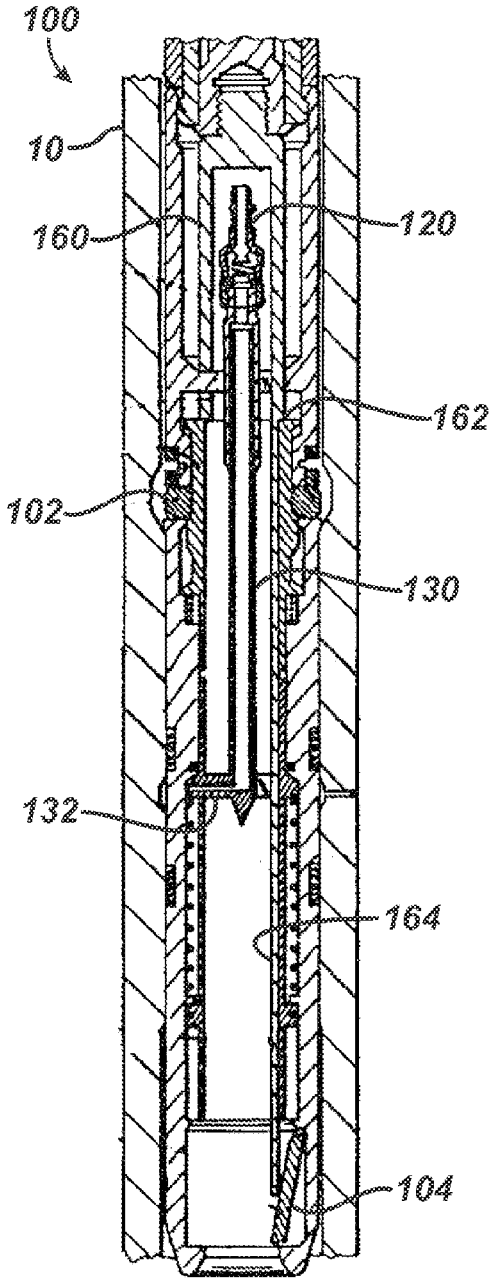
FIG. 1A (Prior Art)
FIGS. 1A-1B illustrate a surface controlled subsurface safety valve according to the prior art.
Figure 1B:
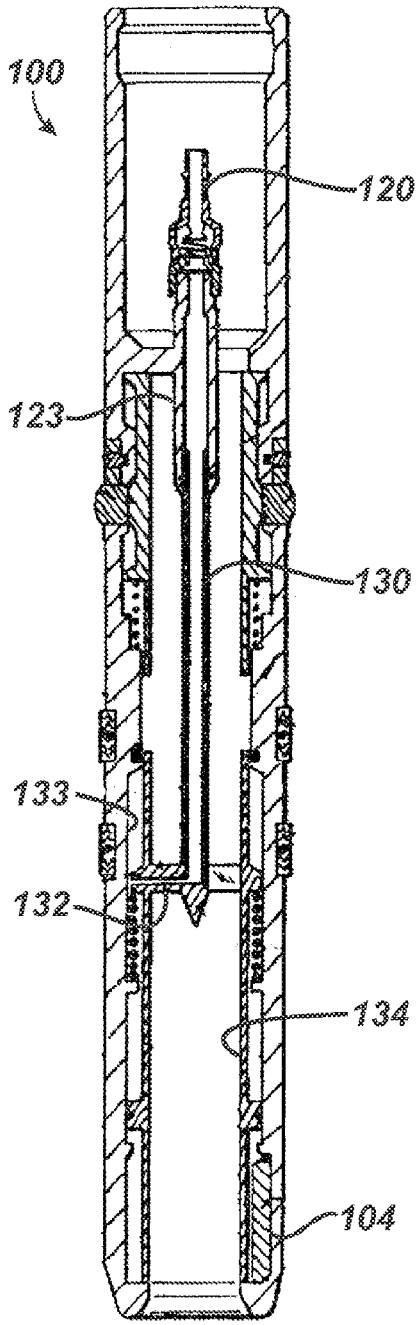
FIG. 1B (Prior Art)
Figure 2A:
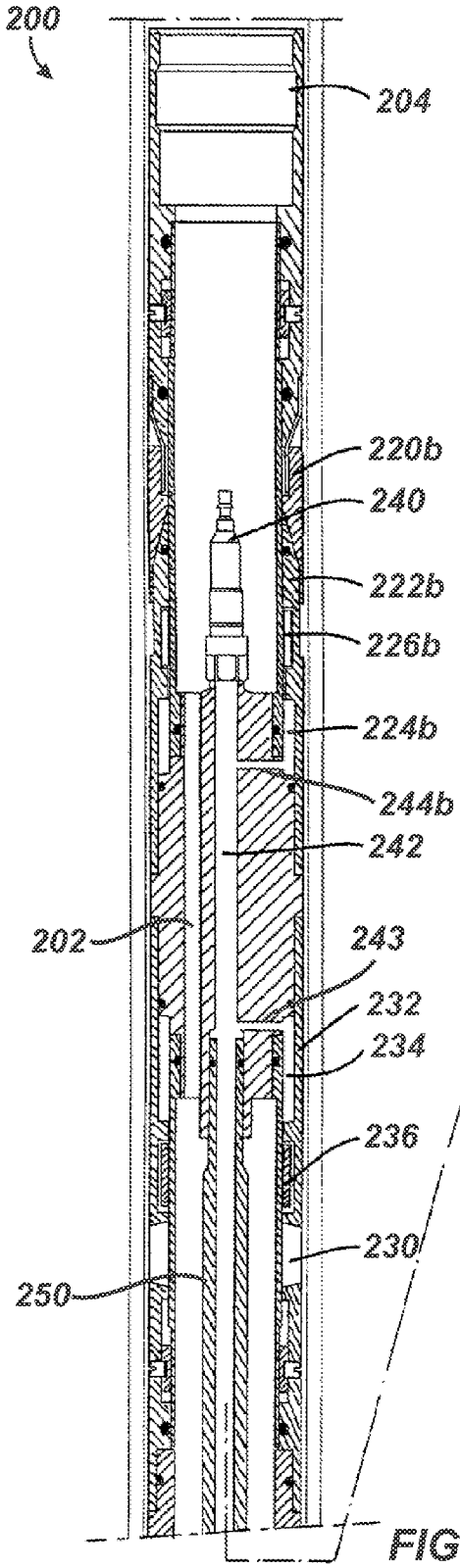
FIG. 2A (Prior Art)
FIGS. 2A-2B illustrate another surface controlled subsurface safety valve according to the prior art.
Figure 2B:
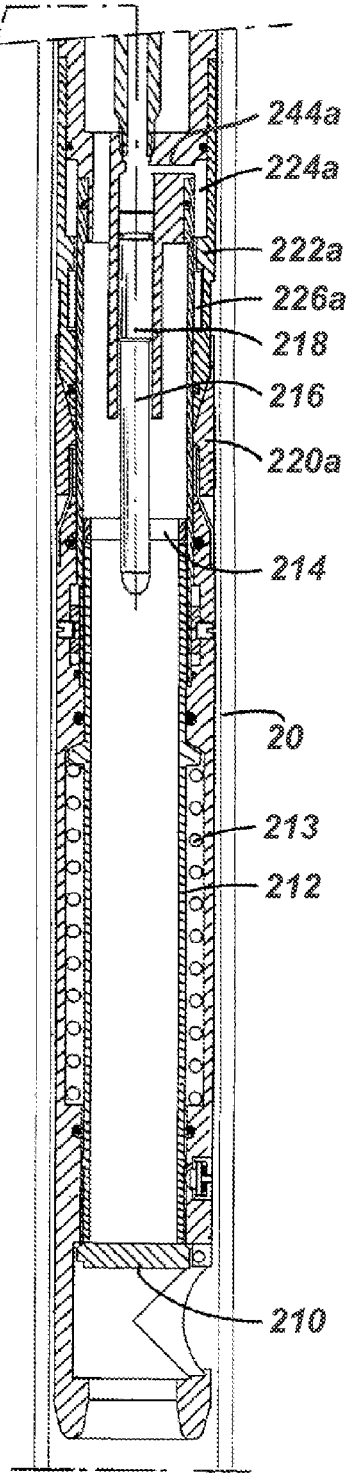
FIG. 2B (Prior Art)
Figure 3:
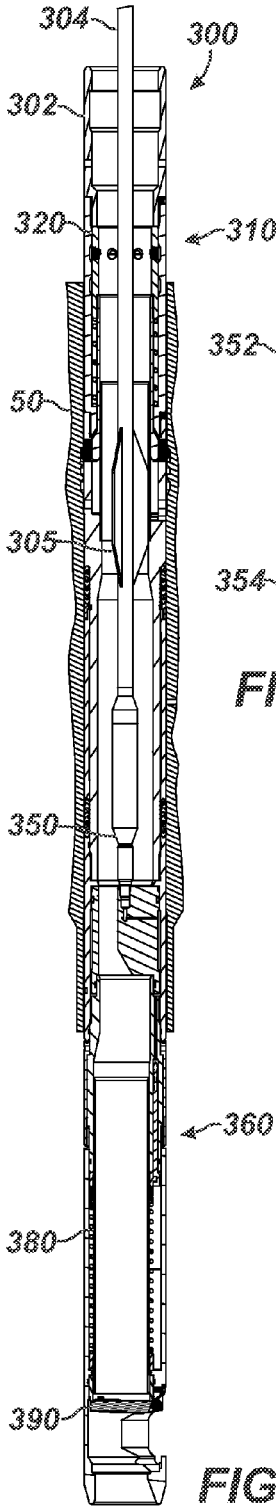
FIG. 3 illustrates a cross-section of a retrievable surface controlled subsurface safety valve according to one embodiment of the present disclosure.

A retrievable surface controlled subsurface safety valve 300 illustrated in FIG. 3 installs in a well having existing hardware for a surface controlled valve and can be deployed in the well using standard wireline procedures. When run in the well, the valve 300 lands in the existing landing nipple 50 after the inoperable safety valve has been removed.

The safety valve 300 has a housing 302 with a landing portion 310 and a safety valve portion 360. The landing portion 310 best shown in FIG. 5A has locking dogs 332 movable on the housing 302 between engaged and disengaged positions. In the engaged position, for example, the locking dogs 332 engage a groove 52 in the surrounding landing nipple 50 to hold the valve 300 in the nipple 50. The valve portion 360 best shown in FIG. 5B has a flapper 390 rotatably disposed on the housing 302. The flapper 390 rotates on a pivot pin 392, and a torsion spring 394 biases the flapper 390 to a closed position.

Figure 5A:
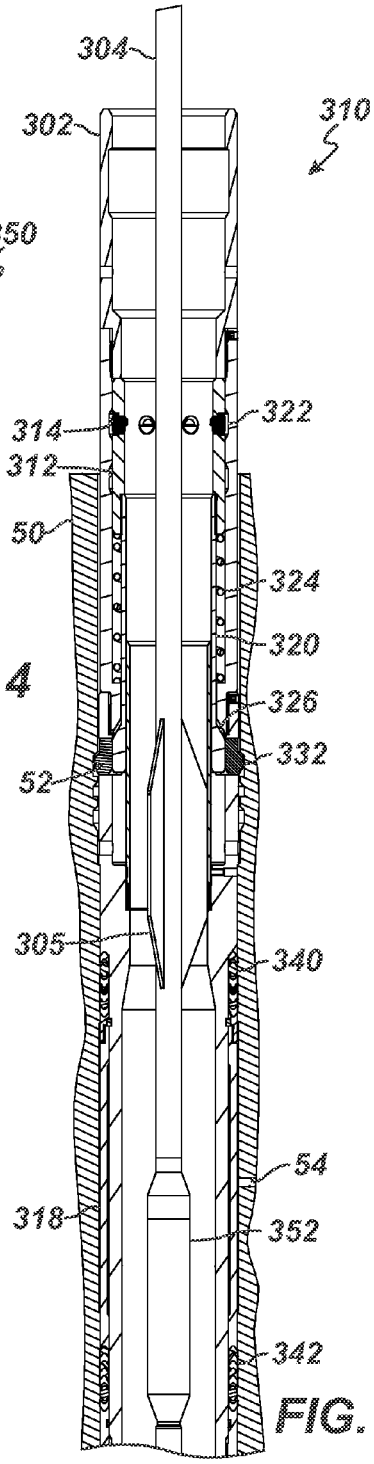
FIG. 5A illustrates a detailed cross-section of an upper portion of the valve in FIG. 3.

To operate the landing portion 310, an upper sleeve 320 shown in FIG. 5A movably disposed within the housing 302 can be mechanically moved between upper and lower locked positions against the bias of a spring 324. In the upper locked position as shown in FIG. 5A, the upper sleeve 320's distal end 326 moves the locking dogs 332 to the engaged position so that they engage the landing nipple's groove 52. Although not shown, the upper sleeve 320 can be mechanically moved to a lower position that permits the locking dogs 332 to move to the disengaged position free from the groove 52.

Figure 5B:
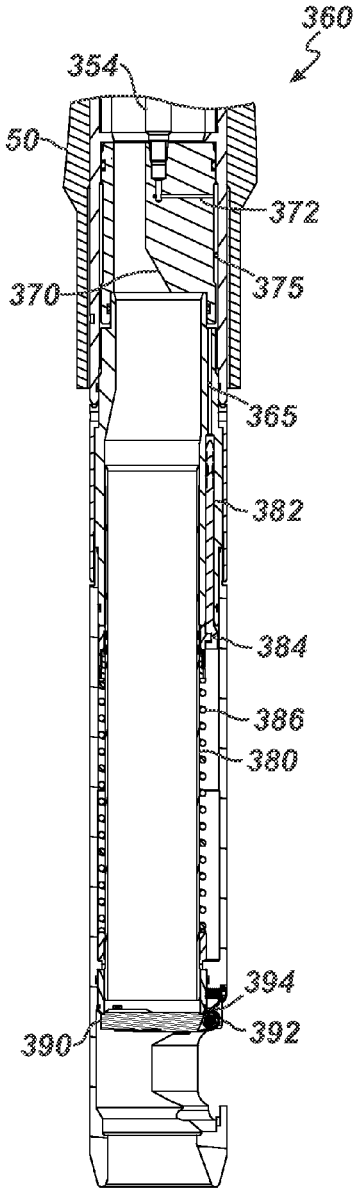
FIG. 5B illustrates a detailed cross-section of a lower portion of the valve in FIG. 3.

To operate the valve portion 360, a lower sleeve 380 shown in FIG. 5B movably disposed within the housing 302 can be hydraulically moved from an upper position to a lower position against the bias of a spring 386. When hydraulically moved to the lower position (not shown), the sleeve 380 moves the flapper 390 open. In the absence of sufficient hydraulic pressure, however, the bias of the spring 386 moves the sleeve 380 to the upper position shown in FIG. 5B, permitting the flapper 390 to close by its own torsion spring 394 about its pivot pin 392.

With a basic understanding of the operation of the valve 300, discussion now turns to a more detailed discussion of its components and operation.

A. Deploying the Valve

In deploying the valve 300, a conventional wireline tool (not shown) couples to the profile in the upper end of the valve's housing 302 and lowers the valve 300 to the landing nipple 50. While it is run downhole, trigger dogs 322 on the upper sleeve 320 remain engaged in lower grooves 312 in the housing 302, while the upper sleeve 320 allows the locking dogs 332 to remain disengaged. When in position, the tool actuates the landing portion 310 by moving the upper sleeve 320 upward against the bias of spring 324 and disengaging the trigger dogs 322 from the lower grooves 312 so they engage upper grooves 314. With the upward movement of the sleeve 320, the sleeve's distal end 326 pushes out the locking dogs 332 from the housing 302 so that they engage the landing nipple's groove 52 as shown in FIG. 5A. Once landed, upper and lower chevrons 340/342 on the housing 302 (separated by element 318) also seal above and below the existing port 54 in the landing nipple 50 provided for the removed valve.

B. Operating the Flapper on the Valve

With the valve 300 landed in the nipple 50, operators lower a capillary string 304 down hole to the valve. This capillary string 304 can be hung from a capillary hanger (not shown) at the surface. The capillary string 304 may include blade centralizers 305 to facilitate lowering the string 304 downhole. The string 304's distal end passes into the valve's housing 302, and a hydraulic connector 350 is used to couple the string 304 to the valve 300. In particular, a female member 352 of the hydraulic connector 350 on the distal end mates with a male member 354 on the valve 300.

Figure 4:
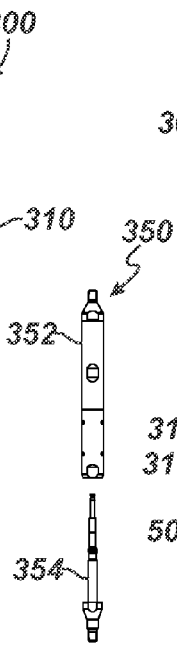
FIG. 4 illustrates an example of male and female members of a preferred quick connector for use with the disclosed valves.

Briefly, FIG. 4 shows one example of a connector 350 that can be used with the valves of the present disclosure. The connector 350 can be an automatic connector from Staubli of France. The male member 354 can have part no. N01219806, and the female member 352 can have part no. N01219906. The connector 350 can an exterior pressure rating of about 350 Bar, an interior pressure rating of 550 Bar when coupled, a coupling force of 25 Kg, and a decoupling force of 200 Kg.

Once the members 352/354 are connected as shown, the capillary string 304 communicates with an internal port 372 defined in a projection 370 within the valve 300 as shown in FIG. 5B. Operators then inject pressurized hydraulic fluid through the capillary string 304. As the fluid reaches the internal port 372, it fills the annular space 375 surrounding the projection 370.

From the annular space 375, the fluid reaches a passage 365 in the valve portion 360 and engages an internal piston 382. Hydraulic pressure communicated by the fluid moves this piston 382 downward against the bias of a spring 386 at the piston's end 384. The downward moving end 384 moves the inner sleeve 380 connected thereto so that the inner sleeve 380 forces open the flapper 390. In this way, the valve portion 360 can operate in a conventional manner. As long as hydraulic pressure is supplied to the piston 382 via the capillary string 304, for example, the inner sleeve 380 maintains the flapper 390 open, thereby permitting fluid communication through the valve's housing 302. When hydraulic pressure is released due to an unexpected up flow or the like, the spring 386 moves the inner sleeve 380 away from the flapper 390, and the flapper 390 is biased shut by its torsion spring 394, thereby sealing fluid communication through the valve's housing 302.

C. Retrieving the Valve

Retrieval of the valve 300 can be accomplished by uncoupling the hydraulic connector 350 and removing the capillary string 304. Then, a conventional wireline tool can engage the profile in valve's upper end, disengage the locking dogs 332 from the nipple's slot 52, and pull the valve 300 up hole.

D. Advantages

As opposed to prior art subsurface controlled safety valves, the disclosed valve 300 has a number of advantages, some of which are highlighted here. In one advantage, the valve 300 deploys in a way that lessens potential damage to the valve's components, such as the male member 354 and movable components. In addition, communication of hydraulic fluid to the safety valve portion 360 is achieved using an intermediate projection 370 and a single port 372 communicating with an annular space 375 and piston 382 without significantly obstructing the flow passage through the valve 300. Furthermore, operation of the valve portion 360 does not involve a number of movable components exposed within the flow passage of the valve 300, thereby reducing potential damage to the valve portion 360.

II. Subsurface Safety Valve with Integral Pack Off

The previous embodiment of safety valve 300 lands into an existing landing nipple 50 downhole. By contrast, a surface controlled subsurface safety valve 400 in FIG. 6 installs in a well that does not necessarily have existing hardware for a surface controlled valve. Here, the valve 400 has a hydraulically-set packer/pack-off portion 410 and a safety valve portion 460 that are both set simultaneously using hydraulic pressure from a safety valve control line.

For the pack-off portion 410, the valve 400 has a packing element 420 and slips 430 disposed thereon. The packing element 420 is compressible from an uncompressed condition to a compressed condition in which the element 420 engages an inner wall of a surrounding conduit (not shown), such as tubing or the like. The slips 430 are movable radially from the housing 402 from disengaged to engaged positions in which they contact the surrounding inner conduit wall. The slips 430 can be retained by a central portion (not shown) of a cover 431 over the slips 430 and may be biased by springs, rings or the like.

For the valve portion 460, the valve 400 has a flapper 490 rotatably disposed on the housing 402 by a pivot pin 492 and biased by a torsion spring 494 to a closed position. The flapper 490 can move relative to the valve's internal bore between opened and closed positions to either permit fluid communication through the valve's bore 403 or not.

Figure 7A:
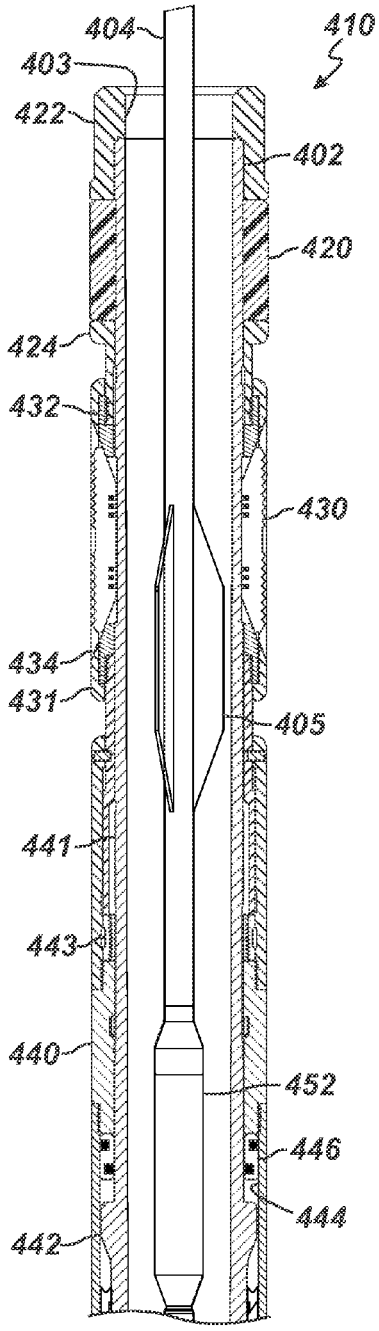
FIG. 7A illustrates a detailed cross-section of an upper portion of the valve in FIG. 6.

To operate the packer portion 410, hydraulic fluid moves an upper sleeve 440. In one position as shown in FIG. 7A, for example, the upper sleeve 440 leaves the packing element 420 in the uncompressed condition. However, when the upper sleeve 440 is hydraulically moved to a lower position, the sleeve 440's movement compresses the packing element 420 into a compressed condition so as to engage the inner conduit wall.

Figure 7B:
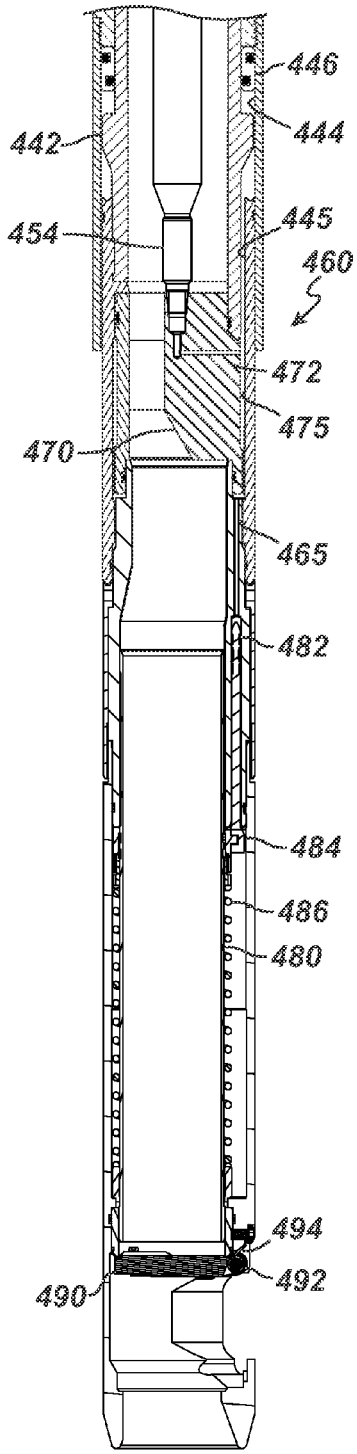
FIG. 7B illustrates a detailed cross-section of a lower portion of the valve in FIG. 6.

To operate the valve portion 460, a lower sleeve 480 shown in FIG. 7B movably disposed within the housing 402 can be hydraulically moved from an upper position to a lower position against the bias of a spring 486. When hydraulically moved to the lower position (not shown), the sleeve 480 moves the flapper 490 open. In the absence of sufficient hydraulic pressure, the bias of the spring 486 moves the sleeve 480 to the upper position, permitting the flapper 490 to close.

With a basic understanding of the operation of the valve 400, discussion now turns to a more detailed discussion of its components and operation.

A. Deploying the Valve

The valve 400 is run in the well using capillary string technology. For example, a capillary string 404 with blade centralizers 405 connects inside the valve housing 400 with a hydraulic connector 450 having both a male member 454 and female member 452 similar to that disclosed in FIG. 3. The valve 400 is then lowered by the capillary string 404 to a desired position downhole, and the string 404 is hung from a capillary hanger (not shown) at the surface. The capillary hanger preferably installs in a wellhead adapter at the wellhead tree. The hanger preferably locks into the gap between the flange of the hanger bowl and the flange of the tree supported above. The hanger seals in the body of the tree using self-energizing packing and is accessed by drilling and tapping the tree.

Once positioned, both the packer portion 410 and the safety valve portion 460 are hydraulically set by control line pressure communicated via the capillary string 404. In particular, the capillary string 404 communicates with internal port 472 defined in a projection 470 positioned internally in the housing 402. Operators then inject pressurized hydraulic fluid through the capillary string 404. When the fluid reaches the internal port 472 as shown in FIG. 7B, it fills the annular space 475 surrounding the projection 470.

From the intermediate annular space 475, the fluid communicates via an upper passage 445 to an upper annular space 444 near the upper sliding sleeve 440. As discussed below, fluid communicated via this passage 445 operate the valve's packer portion 410. From the intermediate annular space 475, the fluid also communicates via a lower passage 465 in the valve portion 460 and engages a piston 480. As discussed below, fluid communicated via this passage 465 operates the valve portion 460.

B. Hydraulically Operating the Pack Off

In operating the valve's packer portion 410, the fluid communicated by upper passage 445 fills the upper annular space 444 which is best shown in FIG. 7B. Trapped by sealing member 446, the fluid increase the size of the space 444 and pushes against the surrounding rib 442, thereby forcing the sleeve 440 upward. As the sleeve 440 moves upward, an upper member 422 connected at the upper end of housing 402 moves toward a lower member 424 disposed about the housing 402. These members 422/424 compress the packer element 420 between them so that it becomes distended and engages an inner conduit wall (not shown) surrounding it. As preferred, this packing element 420 is a solid body of elastomeric material to create a fluid tight seal between the housing and the surrounding conduit.

As the sleeve 440 moves upward, it moves not only upper and lower members 422/424 but also moves an upper wedged member 432 toward a lower wedged member 434 fixed to lower members of the sleeve 440. As the sleeve 440 moves upward, therefore, the wedged members 432/434 push the slips 430 outward from the housing 402 to engage the inner conduit wall (not shown) surrounding the housing 402. Eventually, as the sleeve 440 is moved, outer serrations or grooves 441 engage locking rings 443 positioned on the housing 402 to prevent the sleeve 440 from moving downward.

C. Hydraulically Operating the Flapper

Simultaneously, the communicated hydraulic fluid operates the safety valve portion 460. Here, hydraulic pressure communicated by the fluid via passage 465 moves the piston 482 downward against the bias of spring 486. The downward moving piston 482 also moves the inner sleeve 480, which in turn forces open the rotatable flapper 490 about its pin 492. In this way, the valve portion 460 can operate in a conventional manner. When hydraulic pressure is released due to an unexpected up flow or the like, the spring 486 moves the inner sleeve 484 away from the flapper 490, and the flapper 490 is biased shut by its torsion spring 494.

D. Retrieving the Valve

Retrieval of the safety valve 400 can use the capillary string 404. Alternatively, retrieval can involve releasing the capillary string 404 and using standard wireline procedures to pull the safety valve 400 from the well in a manner similar to that used in removing a downhole packer.

E. Advantages

As opposed to the prior art surface controlled subsurface safety valves, the disclosed valve 400 has a number of advantages, some of which are highlighted here. In one advantage, the valve 400 uses a solid packing element and slip combination to produce the pack-off in the tubing. This produces a more superior seal than found in the prior art which uses a pile of packing cups. Second, the flapper 490 of the valve 400 is operated using an annular rod piston arrangement with the components concealed from the internal bore of the valve 400. This produces a more reliable mechanical arrangement than that found in the prior art where rod, piston, and tubing connections are exposed within the internal bore of the prior art valve. Third, the packing element 420 and the rod piston 482 in the valve are actuated via hydraulic fluid from one port 472 communicating with the coil tubing 404. This produces a simpler, more efficient communication of the hydraulic fluid as opposed to the multiple cross ports and chambers used in the prior art.

F. Capillary Deployment

Finally, the disclosed valve 400 can be deployed using a capillary string or coil tubing ranging in size from 0.25" to 1.5" and can be retrieved by either the capillary string or by standard wireline procedures. Deploying the valve 400 (as well as valve 300 of FIG. 3) can use a capillary hanger that installs in a wellhead adapter at the wellhead tree and that locks into the gap between the flange of the hanger bowl and the flange of the tree supported above. This capillary hanger preferably seals in the body of the tree using self-energizing packing and is accessed by drilling and tapping the tree.

1. Capillary Hanger Used with Adapter Having Cross Ports

Figure 6:
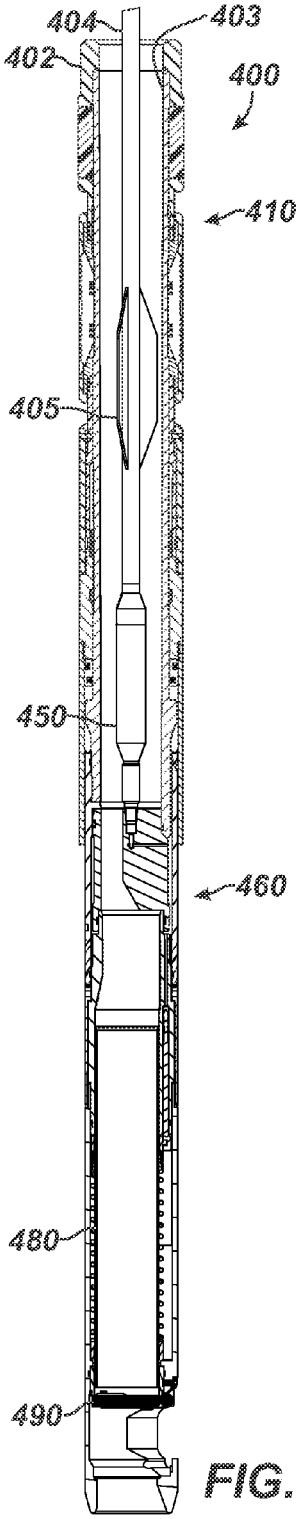
FIG. 6 illustrates a cross-section of a retrievable surface controlled subsurface safety valve according to another embodiment of the present disclosure.
Figure 8A:
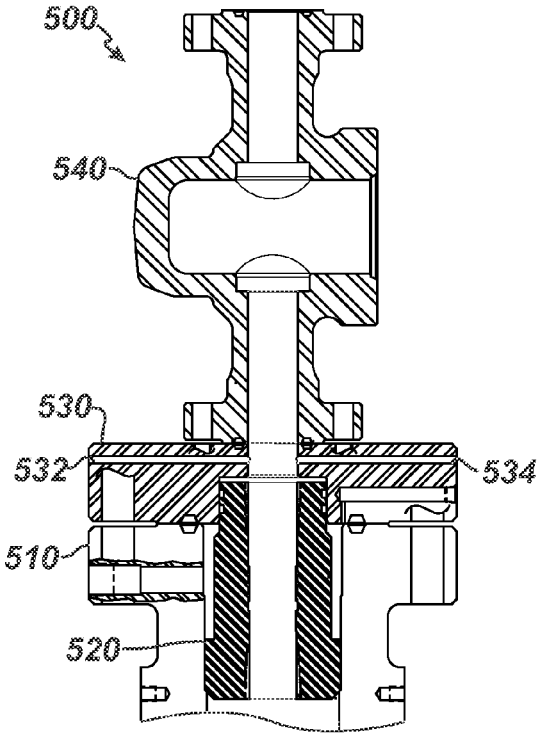
FIGS. 8A-8D illustrate cross-sectional views of a wellhead assembly in various stages of deploying the surface controlled safety valve of FIG. 6.

For example, FIGS. 8A-8D show a wellhead assembly 500 in various stages of deploying a surface controlled safety valve (not shown), such as valve 400 of FIG. 6. As shown in FIG. 8A, the assembly 500 includes an adapter 530 that bolts to the flange of a wellhead's hanger bowl 510 and that supports a spool, valve or one or more other such tree component 540 thereabove. A tubing hanger 520 positioned in the hanger bowl 510 seals with the adapter 530 and supports tubing (not shown) downhole. It is understood that the wellhead assembly 500 will have additional components that are not shown.

Initially, the surface controlled safety valve (400; FIG. 6) is installed downhole using capillary string procedures so that the valve seats in the downhole tubing according to the techniques discussed previously. The length of capillary string used to seat the valve can be measured for later use. After removing the capillary string and leaving the seated valve, operators may install a packer downhole as a secondary barrier. Then, operators drill and tap the adapter 530 with a control line port 532 and one or more retention ports 534 that communicate with the adapter's central bore. These ports 532 and 534 are offset from one another.

Figure 8B:
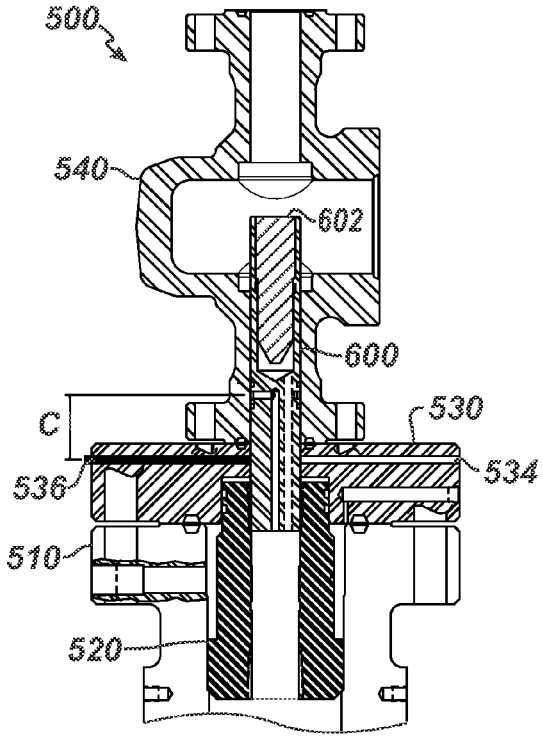
Figure 9A:
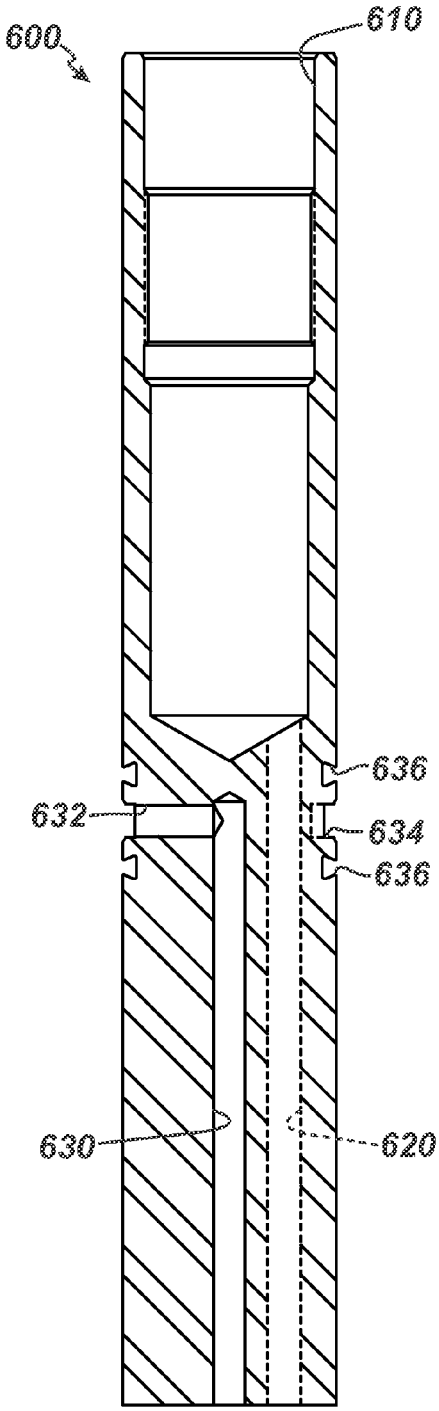
FIG. 9A is a detailed cross-section of a capillary hanger of the assembly of FIGS. 8A-8D.
Figure 9B:
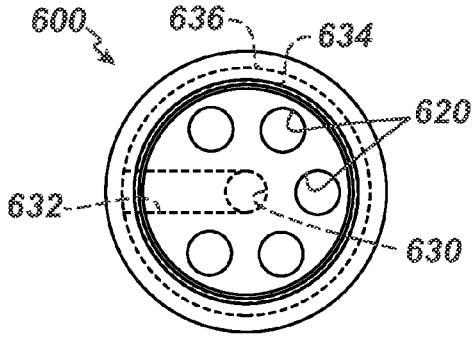
FIG. 9B is a top view of the capillary hanger of FIG. 9A.

As shown in FIG. 8B, operators then install a capillary hanger 600 through the tree component 540 using a seating element 602 that threads internally in the hanger 600. FIGS. 9A-9B show detailed views of the capillary hanger 600. Once installed, the hanger 600 seats on the tubing hanger 520, but the side port (632; FIG. 9A-9B) on the hanger 600 is offset a distance C from the control line port 532. Operators measure the point where the control line port 532 aligns with the hanger 600 and use this measurement to determine what length at the end of the hanger 600 must be cut off so that the hanger's side port (632; FIG. 9A) can align with the control line port 532.

Figure 8C:
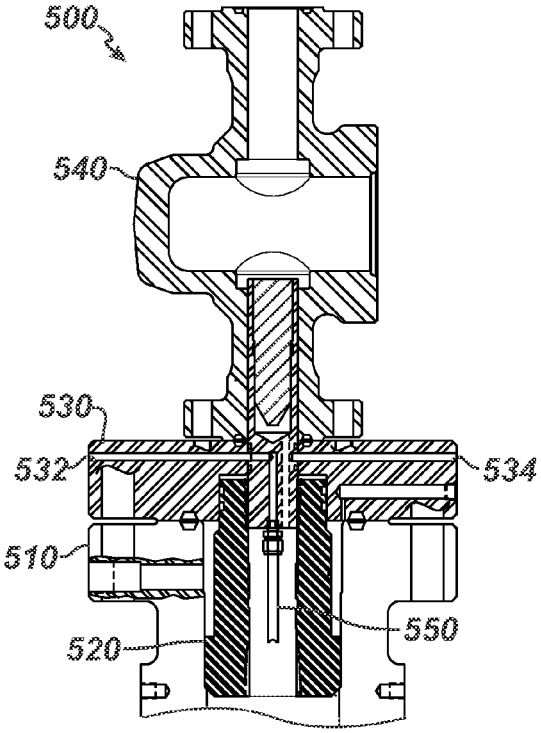

As shown in FIG. 8C, the excess on the end of the hanger 600 is removed, and operators secure a downhole capillary string or control line 550 to the central control line port (630; FIGS. 9A-9B) on the hanger 600. Then, operators pass the capillary string 550 through the spool 540, adapter 530, tubing hanger 520, and head 510 and seat the capillary hanger 600 on the tubing hanger 520. With the hanger 600 seated, a quick connector (not shown) on the end of the capillary string 550 mates inside the safety valve (not shown) downhole according to the techniques described above. With the hanger 600 seated, upper and lower seals within the hanger's grooves (636; FIG. 9A) seal insides the adapter 530 above and below the ports 534 and 536 to seal the capillary hanger 600 in the assembly 500.

Figure 8D:
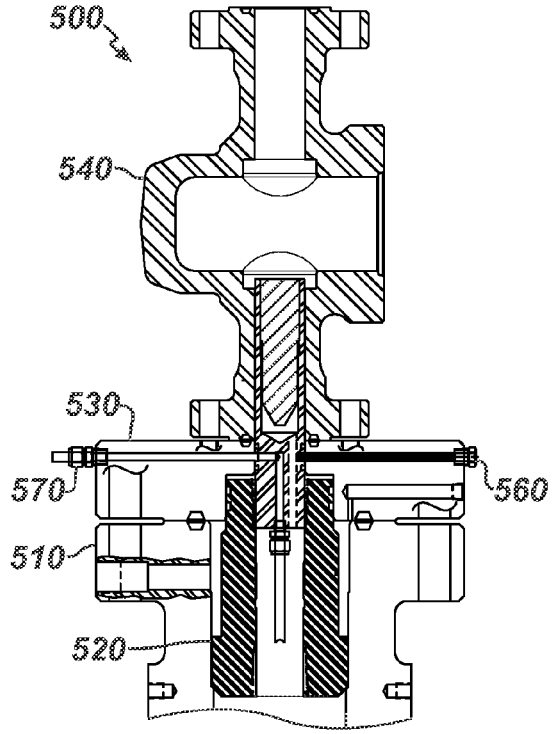

Finally, as shown in FIG. 8D, operators insert and lock one or more retention rods 560 in the one or more retention ports 534 so that they engage in the peripheral slot (634; FIGS. 9A-9B) around the hanger 600 to hold the hanger 600 in the adapter 530. With the hanger 600 secured, operators connect a fitting and control line 570 to the control line port 532 on the adapter 530 so the downhole safety valve can be hydraulically operated via the capillary string 550. Eventually, the seating element 600 can be removed from the capillary hanger 600 so that fluid can pass through axial passages (620; FIGS. 9A-9B) in the hanger 600.

2. Capillary Hanger Used with Gate Valve and Adapter Having Ports

Figures 10A, 10B, 10C:
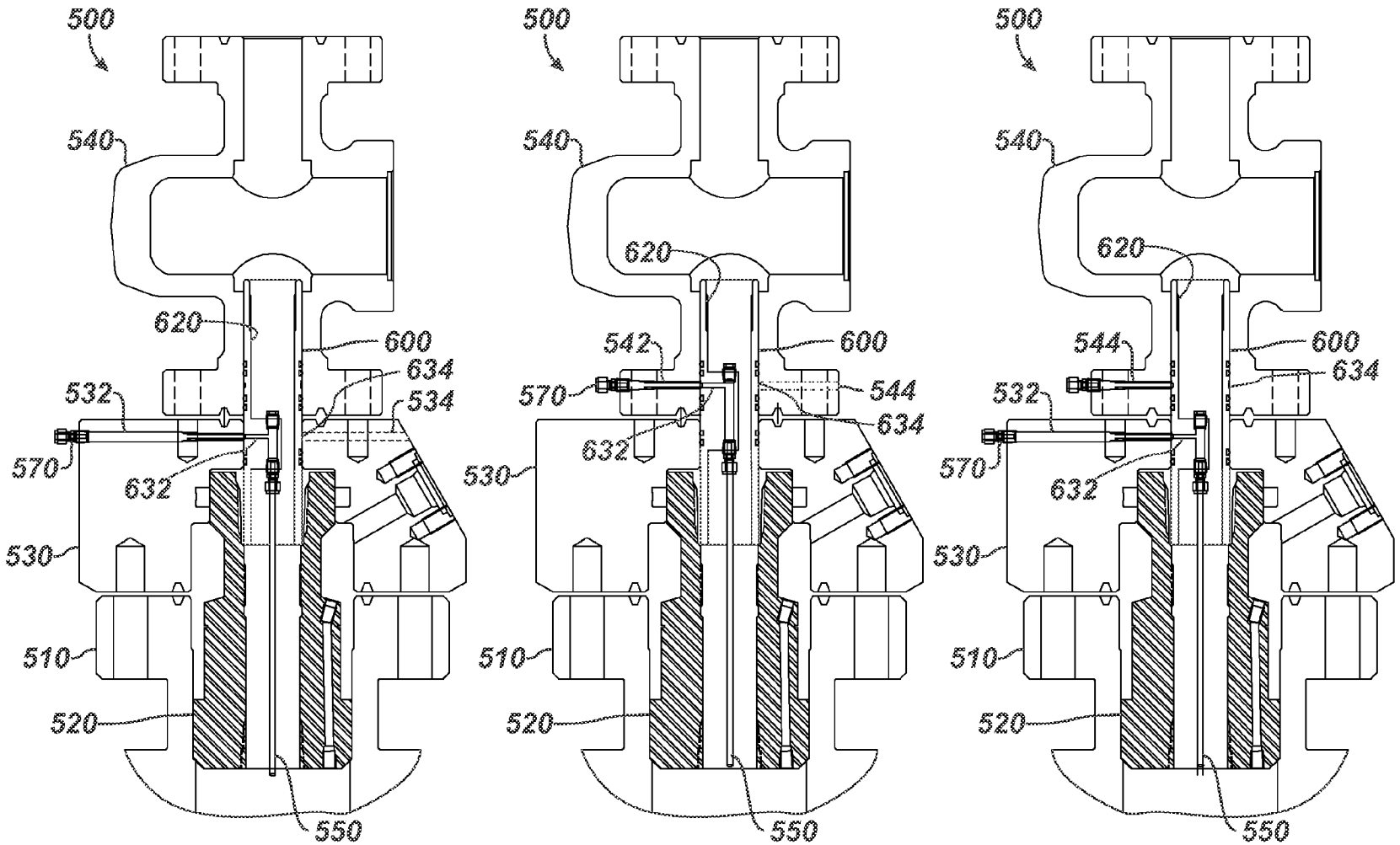
FIGS. 10A-10C show additional capillary hanger arrangements for deploying a control line in a wellhead assembly.

FIGS. 10A-10C show additional wellhead assemblies 500 in which a capillary hanger 600 can be used to deploy a capillary string 550 for a downhole hydraulic tool, such as a surface controlled safety valve in FIG. 6. As shown in FIGS. 10A-10C, the assemblies 500 each have a hanger bowl 510, a tubing hanger 520, an adapter 530, and a gate valve 540 similar to those discussed previously. In these assemblies 500, the side port 632 in the capillary hanger 600 can communicate with a control line port in the adapter 530 (i.e., port 532 in FIG. 10A) or in the gate valve 540 (i.e., port 542 in FIG. 10B). In addition, the capillary hanger 600 can be retained by one or more retention ports in the adapter 530 (i.e., port 534 in FIG. 10A) or in the gate valve 540 (i.e., port 544 in FIG. 10B). Likewise, the hanger 600 in FIG. 10C can communicate with a control line port 532 in the adapter 530 and can be retained by a retention port 544 in the gate valve 540.

In each of these arrangements, the surface controlled safety valve (e.g., 400; FIG. 6) or other hydraulic tool can initially be installed downhole using capillary string procedures. After removing the capillary string, operators drill and tap the control line ports and retention ports as detailed above. For example, operators can drill and tap both ports 532, 534 in the adapter 530 (FIG. 10A), both ports 542, 544 in the gate valve 540 (FIG. 10B), or one port 532 in the adapter 530 and one port 544 in the gate valve 540 (FIG. 10C).

After tapping the wellhead components, operators drift either a suitably sized conduit or the capillary hanger 600 itself through the gate valve 540 and land it in the tubing hanger 620. Operators then measure the axial distance between the control line port (532 or 542) and the landing position on the tubing hanger 620. Using that measured distance, operators then remove any excess length from the end of the capillary hanger 600 so that once the hanger 600 is installed in the wellhead and landed on the landing position, the hanger's side port will be at the needed level to communicate with the control line port (532 or 534).

Having a properly sixed hanger 600, operators then secure the capillary string 550 onto the hanger 600 and pass the string 550 through the assembly 500. The hanger 600 then seats on the tubing hanger 520 to support the string 550 downhole. With the hanger 600 seated, first seals on the hanger 600 can seal inside the gate valve 540, and second seals on the hanger 600 can seal inside the adapter 530. For example, the hanger's seals in FIG. 10A seal the ports 532, 534, the seals in FIG. 10B seal the ports 542, 544, and the seals in FIG. 10C seal ports 532, 544 from the wellhead's bore.

Finally, operators insert and lock one or more retention rods (not shown) in the one or more retention ports 534 and/or 544 so that the rods engage in the peripheral slot 634 around the hanger 600 to hold it in the assembly 500. With the hanger 600 secured, operators connect a control line fitting 570 to the control line port 532 or 542 to communicate hydraulic fluid with the capillary string 550 through the capillary hanger 600. Eventually, wellbore fluid can pass through a flow passage 620 in the hanger 600.

3. Capillary Hanger Used with Gate Valve Bonnet and Seat Having Ports

In yet another alternative, a capillary string can be deployed through the wellhead and used for a downhole safety valve or other hydraulic tool without the need for hot-tapping the wellhead components as in previous arrangements. In this technique, the existing gate valve's seat and bonnet are modified to accept a control line. This eliminates the need to drill holes in an adapter, in a gate valve flange or body, or in another wellhead component to install and secure a capillary hanger.

Figure 11A:
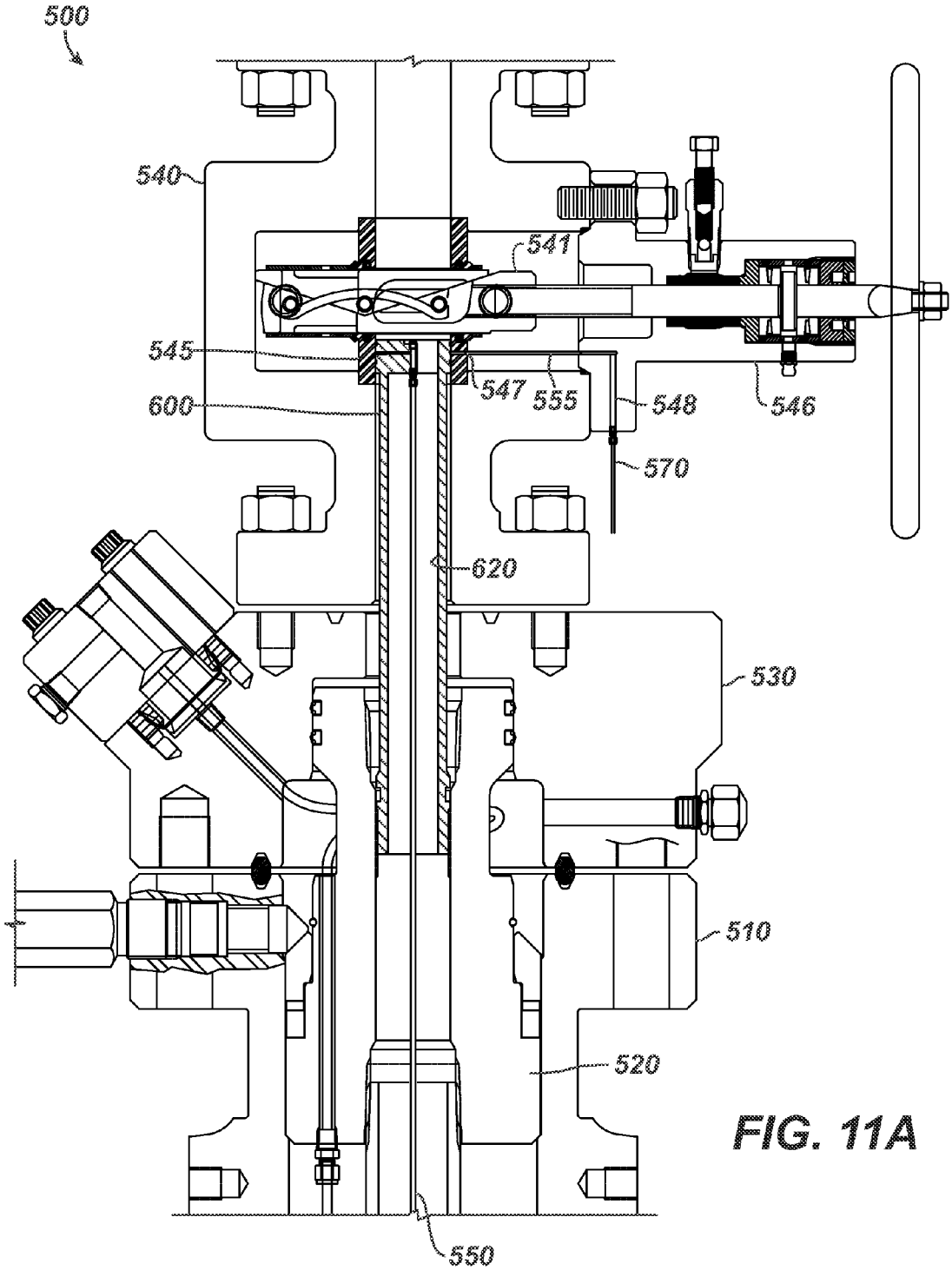
FIGS. 11A-11B show a capillary hanger arrangement for deploying a control line in a wellhead assembly without the need to hot tap components of the assembly.

As shown in FIG. 11A, the wellhead assembly 500 includes a hanger bowl 510, a tubing hanger 520, an adapter 530, and a gate valve 540 as before. Operators remove the gate valve bonnet 546 and the gate valve mechanism 541. Then, operators either drill an aperture 547 in the seat 545 or replace the existing seat 545 with one already having the aperture 547 formed therein.

At this point, operators can install the capillary hanger 600. In this arrangement, the required length of the hanger 600 may be known because the axial distance between the gate valve's seat 545 and the tubing hanger 520 may be known. Alternatively, operators may drift the hanger 600 itself or some other suitably sized conduit through the wellhead and land it on the tubing hanger 520. Then, operators can measure the axial distance from this tubing hanger's seating location to the valve seat's aperture 547. This measured distance can then be used to modify the length of the hanger 600 or to design a new hanger 600 with the appropriate axial length from the side port 632 to the landing end on the hanger 600.

With a properly sized hanger 600, operators install the safety valve or other hydraulic tool downhole using capillary string procedures. Then, operators attach the capillary string 550 to the inner port end of the capillary hanger 600 and install the string 550 through the wellhead. Eventually, operators seat the distal end of the capillary hanger 600 in the tubing hanger 520. In seating, the hanger 600 may thread into the bore of the tubing hanger 620. Also, a seal (not shown) may be provided in a surrounding notch on the hanger's landing end so it can seal against the inside of the tubing hanger 620.

Figure 11B:
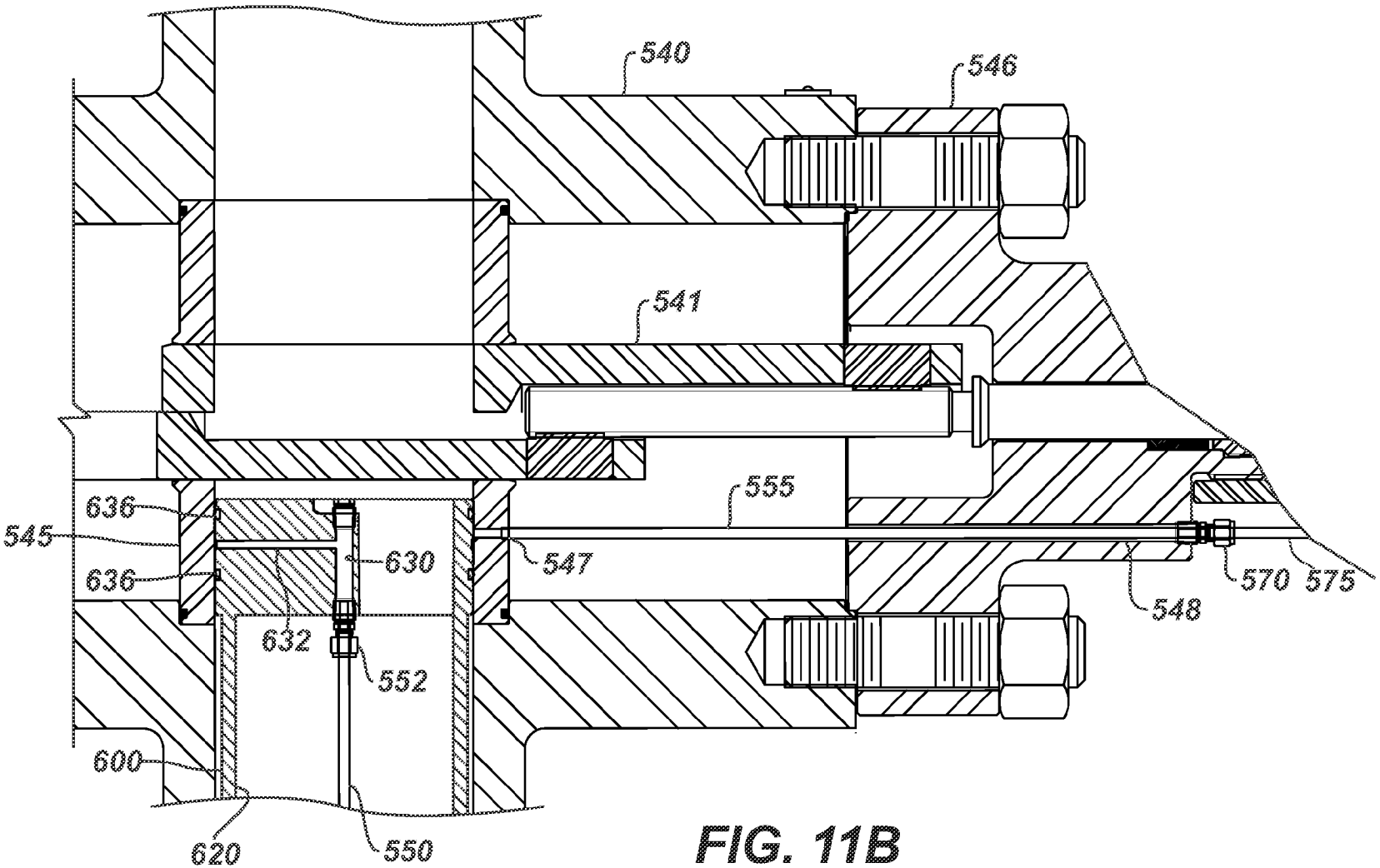

As shown in more detail in FIG. 11B, seals 636 on the seated hanger 600 seal against the inside of the gate valve seat 545 and seal the hanger's side port 632 from the wellhead's bore. The aperture 547 in the seat 545 communicates with the sealed space between these seals 636 and communicates with the side port 632. Operators connect one end of an auxiliary line 555 to the seat's aperture 547 by preferably threading the line 555 into the aperture 547. The other end of the line 555 connects to the control line port 548 in the gate valve's bonnet 546.

The control line port 548 can be angled as in FIG. 11A or can be straight as in FIG. 11B. As best shown in FIG. 11B, the auxiliary line 555 may be longer than the distance between the bonnet 546 and the seat 545. Having this extra length, the end of the line 555 can first be connected to the seat's aperture 547, and then the bonnet 546 can be fit onto the valve 540 with at least a portion of the line 555 extending into the control line port 548 on the bonnet 546. The excess length of the line 555 fitting entirely or partially inside the control line port 548 can be sealed therein using techniques known in the art. In FIG. 11A, for example, the line 555 passes through the control line port 548 and is at least partially sealed therein by the fitting 570.

Finally, a control line 575 connected to the fitting 570 at the port 548 on the bonnet 546 can communicate with the capillary string 550 via control line 555, aperture 547, and hanger 600 so that the downhole safety valve or other hydraulic tool can be hydraulically operated. Eventually, fluid in the wellhead assembly 500 can pass through the axial flow passage 620 in the hanger 600.

To install this arrangement, a replacement seat 545 and bonnet 546 can be provided for the particular installation, and the modified replacement parts can be installed at the wellsite to adapt the assembly 500 for deploying the capillary string 500. Alternatively, operators can directly modify the existing seat 545 and bonnet 546 at the installation. Making modifications to the bonnet 546 and seat 545 is preferred over hot-tapping the gate valve or any other components of the assembly 500. The needed modifications will depend on the particular gate valve 540. Likewise, the required length of the hanger 600 may vary depending on the implementation and may be already known or determined during installation.

4. Capillary Hanger and Gate Valve Seat Combinations

An alternative arrangement shown in FIG. 12 again has a capillary hanger 600 that disposes in the gate valve seat 545 as before. Also, an auxiliary line 555 extends from the seat's aperture 547 to the control line port 548 in the valve's bonnet 546. The hanger 600, capillary line 550, seat 545, and other components of this arrangement can be installed in much the same way as discussed above.

Here, however, the hanger 600 does not extend down through the wellhead to seat in the tubing hanger 620 as in FIGS. 11A-B. Rather, the hanger 600 fits mainly in the valve's seat 545 and can be held therein in a number of ways. For example, an interference fit assisted by the seals 636 may hold the hanger 600 in the bore through the seat 545. Also, additional apertures can be drilled through the sides of the seat 545, and retention pins 638 can thread or fit inside these apertures so their distal ends can engage in the external pocket 634 surrounding the hanger's outside surface. In addition, the seat 545 may have its inner passage milled out with a greater diameter to accommodate the hanger 600 and may be provided with a shoulder (not shown) to engage either the upper or lower edge of the hanger 600 to help retain the hanger 600 in the seat 545. Moreover, the outer surface of the hanger 600 and the inner surface of the seat 545 can be provided with threads. These and other techniques can be used to hold the hanger 600 in the seat 545.

Figure 13:
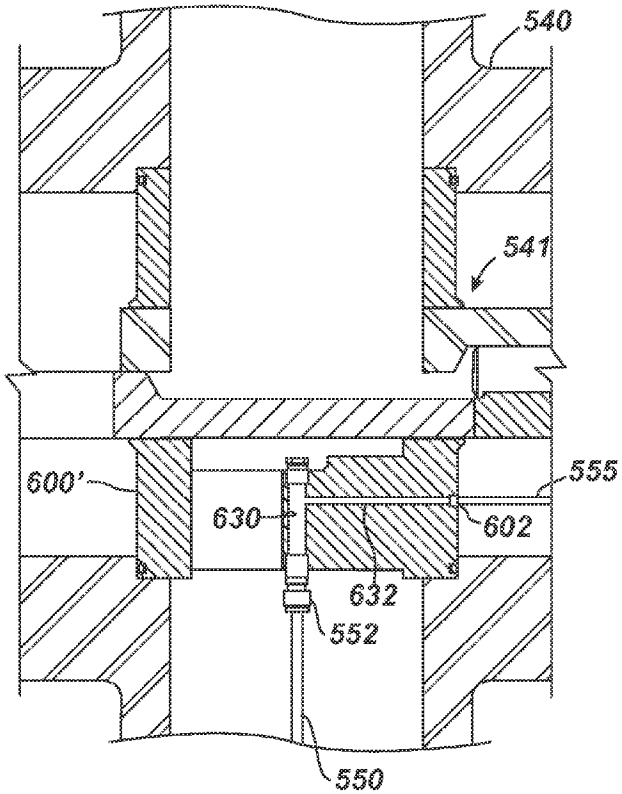
FIG. 13 shows a capillary hanger and gate valve seat arrangement for deploying a control line in a wellhead assembly without the need to hot tap components of the assembly.

In yet another alternative shown in FIG. 13, features of a capillary hanger and gate valve seat disclosed herein are combined together so that operators can deploy the capillary string 550 in the wellhead without the need to hot tap components of the wellhead. As shown, a hanger-seat element 600' has features of both a capillary hanger and a gate valve seat discussed previously but integrated together. In this arrangement, operators design the hanger-seat element 600' as a replacement part for the particular gate valve 540 at the wellhead. Knowing the type of valve, its dimensions, and other characteristics, for example, the hanger-seat element 600' can be particularly designed for the installation at the wellsite.

Figure 12:
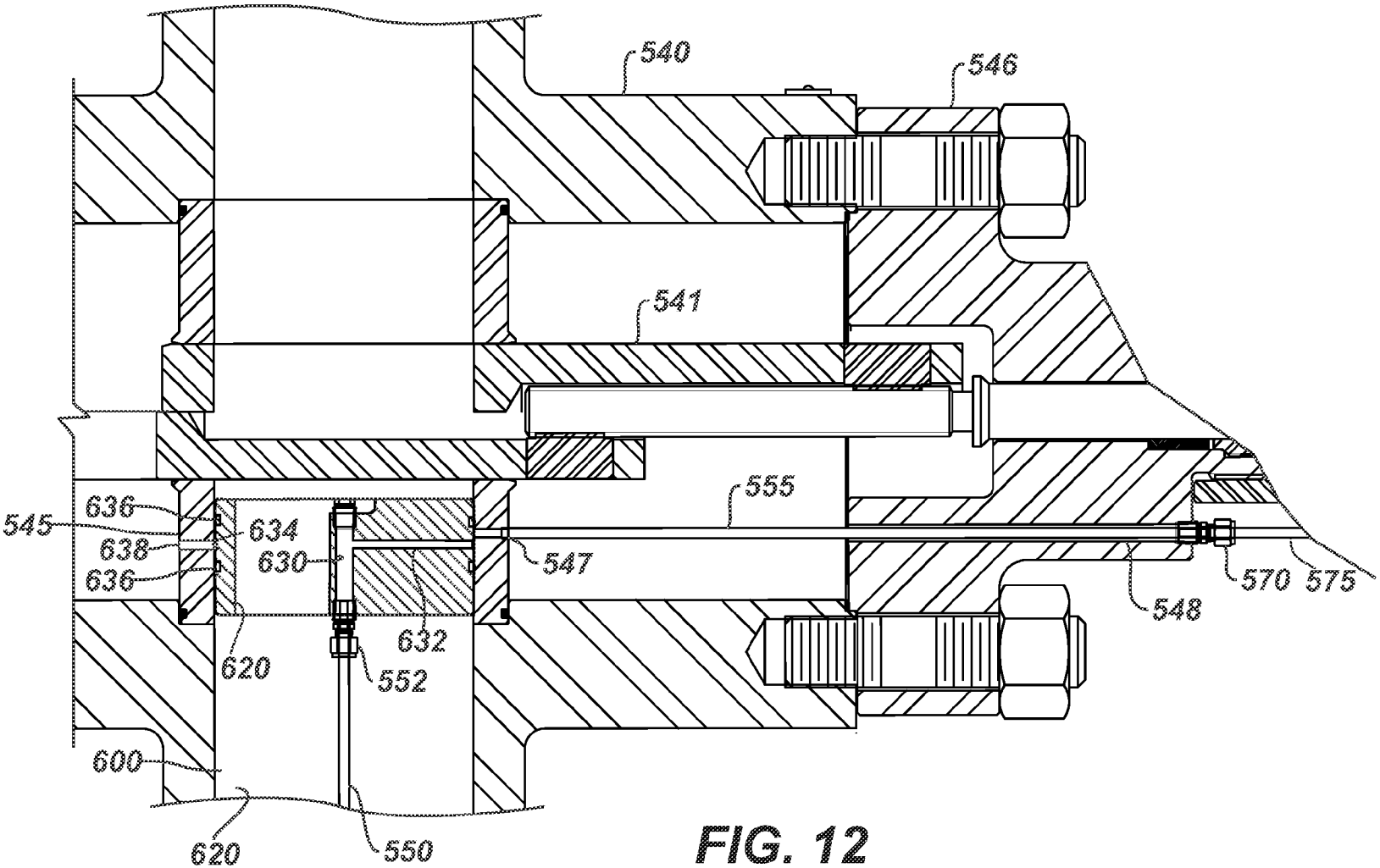
FIG. 12 shows an alternate capillary hanger arrangement for deploying a control line in a wellhead assembly without the need to hot tap components of the assembly.

To install this replacement element 600', operators remove the gate valve mechanism 541, connect the capillary string 550 to the inner port end of the element 600' with a fitting 552, and deploy the string 550 through the wellhead. As they deploy the string, operators eventually position the hanger-seat element 600' in the gate valve 540 below the location where the gate mechanism 541 situates. Then, operators thread the end of the line 555 to the side port 602 in the element 600', fit the gate valve mechanism 541 back in the gate valve's housing, and fit a redesigned or modified bonnet (e.g. 546; FIG. 12) onto the gate valve 540 in a fashion similar to that discussed previously. Eventually, a control line and fitting (570; FIG. 12) coupled to the internal line 555 can communicate with the capillary string 550 via the internal passage 630 and side port 632 of the hanger-seat element 600'.

5. Tubing Hanger and Hanger Bowl with Port

Figure 14:
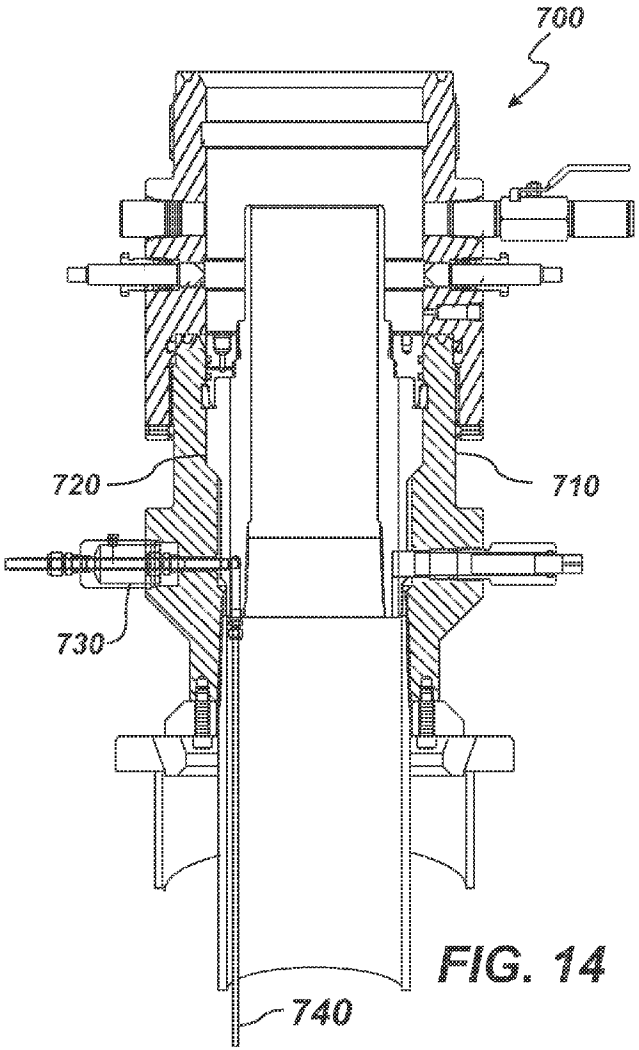
FIG. 14 is a cross-sectional view of another wellhead assembly for deploying a surface controlled safety valve according to the present disclosure.

Another alternative for deploying the surface controlled safety valve (400; FIG. 6) or other hydraulic tool can use one of the hanger and wellhead arrangements disclosed in U.S. Pat. No. 7,779,921, which is incorporated herein by reference. As shown in FIG. 14, for example, a wellhead arrangement 700 has a hanger bowl 710 and tubing hanger 720. A capillary string 740 connects to the downhole valve (not shown) and to the bottom end of the tubing hanger 720. Fluid communication with the string 740 is achieved by drilling and tapping a connection 730 in the hanger bowl 710 that communicates with a side port in the tubing hanger 720.

The foregoing description of preferred and other embodiments is not intended to limit or restrict the scope or applicability of the inventive concepts conceived of by the Applicants. Although the capillary hanger arrangements have been described for use with a surface controlled subsurface safety valve, it will be appreciated with the benefit of the present disclosure that the disclosed arrangements can be used with any other downhole tool that uses a control line for operation. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellhead capillary string deployment method, comprising:

installing a gate valve seat in a gate valve of a wellhead, the gate valve seat defining a flow passage for the gate valve and defining an internal passage;

attaching a capillary string to the internal passage in the gate valve seat;

communicating the internal passage in the gate valve seat with a control line port defined in the gate valve; and supporting a valve mechanism of the gate valve on the gate valve seat.

2. The method of claim 1, wherein communicating the internal passage in the gate valve seat with the control line port in the gate valve comprises:

installing a bonnet on the gate valve, the bonnet defining the control line port; and communicating the internal passage with the control line port defined in the bonnet.

3. The method of claim 2, wherein installing the bonnet comprises:

tapping the control line port in the bonnet used on the gate valve; or replacing an existing bonnet of the gate valve with the bonnet defining the control line port.

4. The method of claim 2, wherein communicating the internal passage with the control line port defined in the bonnet comprises installing a line that connects to a port of the internal passage and that extends through the gate valve to the control line port defined in the bonnet.

5. The method of claim 1, wherein communicating the internal passage in the gate valve seat with the control line port defined in the gate valve comprises connecting a line between a port of the internal passage and the control line port.

6. The method of claim 1, further comprising:

coupling the capillary string to a hydraulic tool downhole from the wellhead; and connecting a control line outside the gate valve to the control line port.

7. The method of claim 1, wherein installing the gate valve seat in the gate valve comprises initially removing a bonnet, the valve mechanism, and an existing gate valve seat from the gate valve.

8. The method of claim 7, wherein installing the gate valve seat in the gate valve comprises further comprises reinstalling the valve mechanism in the gate valve to seat on the installed gate valve seat after installing the gate valve seat.

9. A wellhead capillary string deployment method, comprising:

installing a hanger device in a gate valve of a wellhead, the hanger device defining a flow passage for the gate valve and defining an internal passage;

communicating the internal passage of the hanger device with a capillary string deploying downhole of the wellhead;

communicating the internal passage of the hanger device with a control line port defined in the gate valve; and seating a valve mechanism of the gate valve on the hanger device.

10. The method of claim 9, wherein communicating the internal passage of the hanger device with the control line port comprises:

installing a bonnet on the gate valve, the bonnet defining the control line port; and communicating the internal passage of the hanger device with the control line port defined in the bonnet.

11. The method of claim 10, wherein installing the bonnet comprises:

tapping the control line port in the bonnet used on the gate valve; or replacing an existing bonnet of the gate valve with the bonnet defining the control line port.

12. The method of claim 10, wherein communicating the internal passage of the hanger device with the control line port defined in the bonnet comprises connecting a line between a port of the internal passage and the control line port.

13. The method of claim 9, further comprising:

coupling the capillary string to a hydraulic tool downhole from the wellhead; and connecting a control line outside the bonnet to the control line port.

14. The method of claim 9, wherein installing the hanger device in the gate valve comprises:

removing an existing gate valve seat from the gate valve; and installing the hanger device as a new gate valve seat in the gate valve.

15. The method of claim 14, wherein installing the hanger device as the new gate valve seat in the gate valve comprises removing the valve mechanism from the gate valve to remove the existing gate valve seat; and wherein seating the valve mechanism of the gate valve on the hanger device comprises reinstalling the valve mechanism in the gate valve to seat on the installed hanger device.

16. The method of claim 9, wherein installing the hanger device in the gate valve comprises replacing an existing seat in the gate valve with the hanger device.

17. The method of claim 9, wherein installing the hanger device in the gate valve comprises:

forming the hanger device by disposing a hanger in a bore of a gate valve seat, the hanger defining the flow passage and the internal passage; and communicating a port of the internal passage through an aperture in the gate valve seat.

18. The method of claim 17, wherein disposing the hanger in the bore of the gate valve seat comprises retaining the hanger in the bore of the gate valve seat.

19. The method of claim 17, wherein communicating the internal passage of the hanger device with the control line port defined in the gate valve comprises connecting a line between the aperture of the gate valve seat and the control line port defined in the gate valve.

20. A capillary string deployment apparatus, comprising:

a hanger device having a seat and a hanger, the seat defining an internal bore therethrough and defining an aperture for communicating with a control line port defined in a gate valve, the seat installing in the gate valve of a wellhead and seating a valve mechanism of the gate valve, the hanger disposed in the internal bore of the seat, the hanger defining a flow passage therethrough for fluid flow through the gate valve and defining an internal passage having first and second ports, the first port adapted to communicate with a capillary string extending downhole from the gate valve, the second port adapted to communicate with the aperture in the seat.

21. The apparatus of claim 20, wherein the hanger device replaces an existing gate valve seat disposed in the gate valve.

22. The apparatus of claim 20, further comprising a bonnet connecting to the gate valve of the wellhead and defining the control line port therein.

23. The apparatus of claim 22, further comprising a line disposing in the gate valve and adapted to communicate the control line port in the bonnet with the aperture in the seat of the hanger device.

24. The apparatus of claim 20, wherein the hanger comprises a pair of seals sealing against the internal bore of the seat.

25. The apparatus of claim 20, wherein the apparatus further comprises a retention rod inserting through a retention port defined in the seat and engaging in a pocket of the hanger.

26. The apparatus of claim 20, further comprising a line disposing in the gate valve and adapted to communicate the control line port in the gate valve with the aperture in the seat.

27. The apparatus of claim 20, further comprising a hydraulic downhole tool coupled to the capillary string and deployed downhole from the gate valve.

28. The apparatus of claim 20, wherein an entire axial length of the hanger is disposed in the internal bore of the seat.

29. The apparatus of claim 20, wherein the hanger has an uphole end extending within the seat and has a downhole end remaining in the gate valve.

30. The apparatus of claim 20, wherein the hanger is affixed in the internal bore of the seat.

31. A capillary string deployment apparatus, comprising:

a gate valve seat installing in a gate valve of a wellhead and seating a valve mechanism of the gate valve, the gate valve seat defining a flow passage therethrough for fluid flow through the gate valve and defining an internal passage having first and second ports, the first port adapted to communicate with a capillary string extending downhole from the gate valve, the second port adapted to communicate with a control line port defined in the gate valve.

32. The apparatus of claim 31, wherein the gate valve seat replaces an existing gate valve seat disposed in the gate valve.

33. The apparatus of claim 31, further comprising a bonnet connecting to the gate valve of the wellhead and defining the control line port therein.

34. The apparatus of claim 33, further comprising a line disposing in the gate valve and adapted to communicate the control line port in the bonnet with the second port in the gate valve seat.

35. The apparatus of claim 31, further comprising a line disposing in the gate valve and adapted to communicate the second port with the control line port.

36. The apparatus of claim 31, further comprising a hydraulic downhole tool coupled to the capillary string and deployed downhole from the gate valve.

37. The apparatus of claim 31, wherein an uphole end of the gate valve seat positions against the valve mechanism, and where a downhole end of the gate valve seat positions against a shoulder in the gate valve.

* * * * *